US007156017B1

(12) United States Patent
Ingraselino

(10) Patent No.: US 7,156,017 B1
(45) Date of Patent: Jan. 2, 2007

(54) METHOD CREATING A PICTURE BY DIFFERENT LAYERED STENCILS

(76) Inventor: Robert Louis Ingraselino, 902 B Ipswich Pl., Coram, NY (US) 11727

( * ) Notice: Subject to any disclaimer, the term of this patent is extended or adjusted under 35 U.S.C. 154(b) by 0 days.

(21) Appl. No.: 11/410,577

(22) Filed: Apr. 25, 2006

(51) Int. Cl.
*B41M 1/12* (2006.01)

(52) U.S. Cl. ..... 101/129; 101/127; 101/115; 33/563; 33/566; 434/87

(58) Field of Classification Search ..... 101/115, 101/126, 127, 127.1, 129; 434/87, 84, 85, 434/88, 91, 92; 33/562, 563, 564, 565, 566
See application file for complete search history.

(56) References Cited

U.S. PATENT DOCUMENTS 373,838 A * 11/1887 Lowenson ..... 101/127
2,630,755 A * 3/1953 Herrin ..... 101/128.4
4,125,658 A * 11/1978 Miles ..... 428/131
5,141,438 A * 8/1992 Spector ..... 434/87
5,195,893 A * 3/1993 Casale ..... 434/87
5,213,504 A * 5/1993 Lee et al. ..... 434/84
5,795,154 A * 8/1998 Woods ..... 434/87
6,055,738 A * 5/2000 Bardeen et al. ..... 33/566
6,237,240 B1 * 5/2001 Nelson et al. ..... 33/566
7,055,259 B1 * 6/2006 Goldman ..... 33/562

* cited by examiner

*Primary Examiner*—Leslie J. Evanisko

(57) ABSTRACT

A coloring book for method is provided creating a picture 51 by different layered stencils with the steps of: Lining up the border stencil holes 21 or holes marked for lining up, then coloring each stencil page for each individual color of the picture. When all colors or pages are colored the master page 20 will have a completed picture 51.

1 Claim, 5 Drawing Sheets

METHOD CREATING A PICTURE BY DIFFERENT LAYERED STENCILS

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of childrens coloring books and more specifically to a coloring book method of creating a detailed picture by seperating each individual color from the picture into its own stencil page.

DESCRIPTION OF THE PRIOR ART

In the prior art there are various types of coloring toys and stencil kits that have been proposed. Typical of these is U.S. Pat. No. 5,141,438 issued to Donald Spector on May 1, 1991.

Another patent was issued to Kea L. Bardeen on Feb. 23, 1998 as U.S. Pat. No. 6,055,738. Yet another U.S. Pat. No. 5,213,504 was issued to James S. W. Lee on May 31, 1991 and still yet another was issued on Mar. 23, 1993 to Angelo J. Casale U.S. Pat. No. 5,195,893.

U.S. Pat. No. 5,141,438

Inventor—Donald Spector

Issued—May 1, 1991

An art craft kit which makes it possible for a child to reproduce a painting, a map, or other multi-colored artwork printed on a master sheet having a pressure sensitive adhesive backing, the master sheet being adhered to the face of a blank canvas or other copy sheet. The printed artwork is dissected into stencil segments, the periphery of each segment being defined by a contoured line defining a selected segment, thereby cutting this line and and seperating the segment which is then removed from the master sheet to expose a corresponding blank segment on the copy sheet. Using the removed stencil segment as a guide, the child colors in the blank segment of the copy sheet to match as best he can, the portion of the artwork appearing on the removed segment. This operation is subsequently repeated until all stencil segments on the master sheet are removed and the artwork is reproduced on the copy sheet.

U.S. Pat. No. 6,055,738

Inventor—Kea L. Bardeen

Issued—Feb. 23, 1998

This invention is directed to a stencil for use in transferring an image to a substrate where the image is formed by an ensemble of individual features for a predetermined image. The stencil comprises a sheet of flexible material and a plurality of holes formed through the sheet. The holes are organized in hole sets such that the holes in each such hole set outline a respective individual feature. The hole sets together define the predetermined image to be transferred. This invention also includes a kit for use in transferring an image to an outer surface of a vegetable.

U.S. Pat. No. 5,213,504

Inventor—James S. W. Lee

Issued—May 31, 1991

A liquid non-poisonous, non-metallic, edible, water soluble coloring fluid fills a felt-tipped marker. A plastic box houses the marker or a plurality of the markers. A surface on the box receives the marks from the felt-tipped marker. In one ombodiment, the box is in the form of a toy vehicle. In other embodiments, there may be a plurality of stencils which can be arranged in a scene or a scroll which may be rolled to display a selected scene. Then a tracing of the scene may be made on an overlaying sheet of transparent plastic. An eraser in the form of a sponge with a plastic handle may be made wet to wash away the marks.

U.S. Pat. No. 5,195,893

Inventor—Angelo J. Casale

Issued—Jan. 9, 1991

A shape retaining stencil for three dimensional image pacement. This is for the placement of images on non-flat objects and surfaces. There is a material that has a plurality of holes defing a pattern, the material is fit against a non-flat object, marks are made through the holes of the sheet, which the dots are connected to provide the pattern on the surface.

While these inventions may be suitable for the purposes for which they were designed, they would not be suitable for the purposes of the present invention, as hereinafter described.

SUMMARY OF THE PRESENT INVENTION

The primary object of the invention is to provide a method that allows a child to easily create a detailed painting by seperating each color from a picture into individual stencil pages wherein the child colors each stencil page onto a master page whereupon the completion of all colors or pages will then complete a very detailed picture.

Another object of the invention is to allow the master page to be lined up correctly through a border that is apart of the picture wherein the border stencil will be colored first and thereafter all other segments can be lined up to the border allowing the user to know each stencil will be colored in the proper place therefore creating the picture.

Another object of the invention is to allow the child to remove the pages so that the picture can be duplicated on any master page that does not allow the book to fit the master page of choice.

The present invention overcomes the shortcomings of the prior art by allowing a child to create a detailed picture or painting by individual stencil pages for each color in the picture or painting also having a border line up stencil to line up the master page. This allows the picture to be developed in detailed color stages.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a Coloring Book for creating a picture by different layered stencils comprising the steps of: Seperate stencil pages for each color of the picture with specific outlines to line up the master page.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

LIST OF REFERENCE NUMERALS

Figure 1:
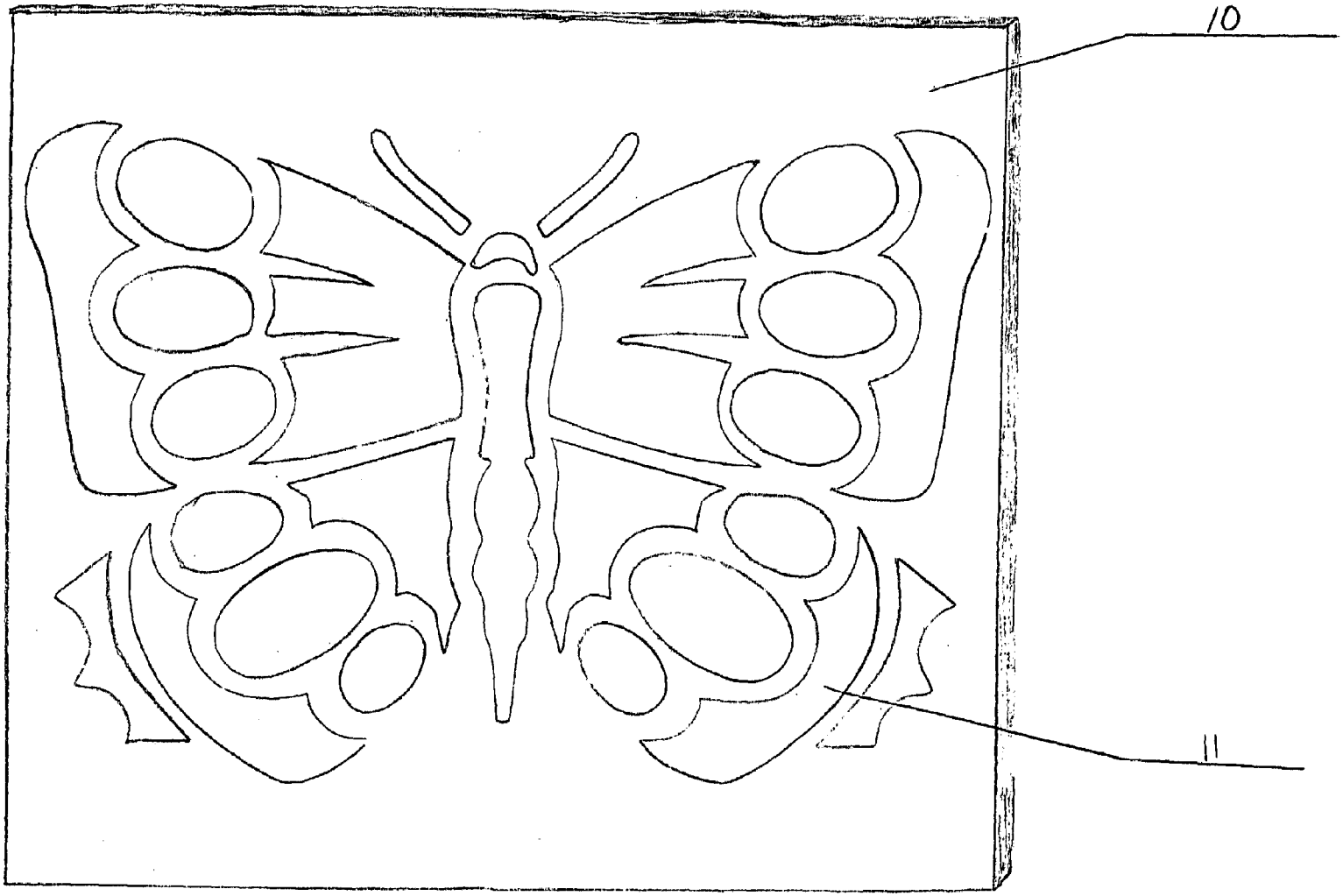
FIG. 1—is a view of the front cover of the book showing the picture that will be created.

With regard to reference numerals used, the following numbering is used throughout the drawings.

10 Coloring Book Cover
11 The Full picture to be reproduced
20 Master Page
21 Border Stencil Hole for coloring and lining up master page
23 Color indicated to color master page black.
31 Stencil holes of all the orange color in the picture
32 Color indicated to use orange for coloring the master page through stencil holes
41 Stencil holes for all the blue color in the picture
42 Color indicated to use blue for coloring the master page through stencil holes
51 Finished Master Page

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Turning to FIG. 1, shown therein is a view of the present inventions cover page 10 and the picture that will be reproduced 11.

Figure 2:
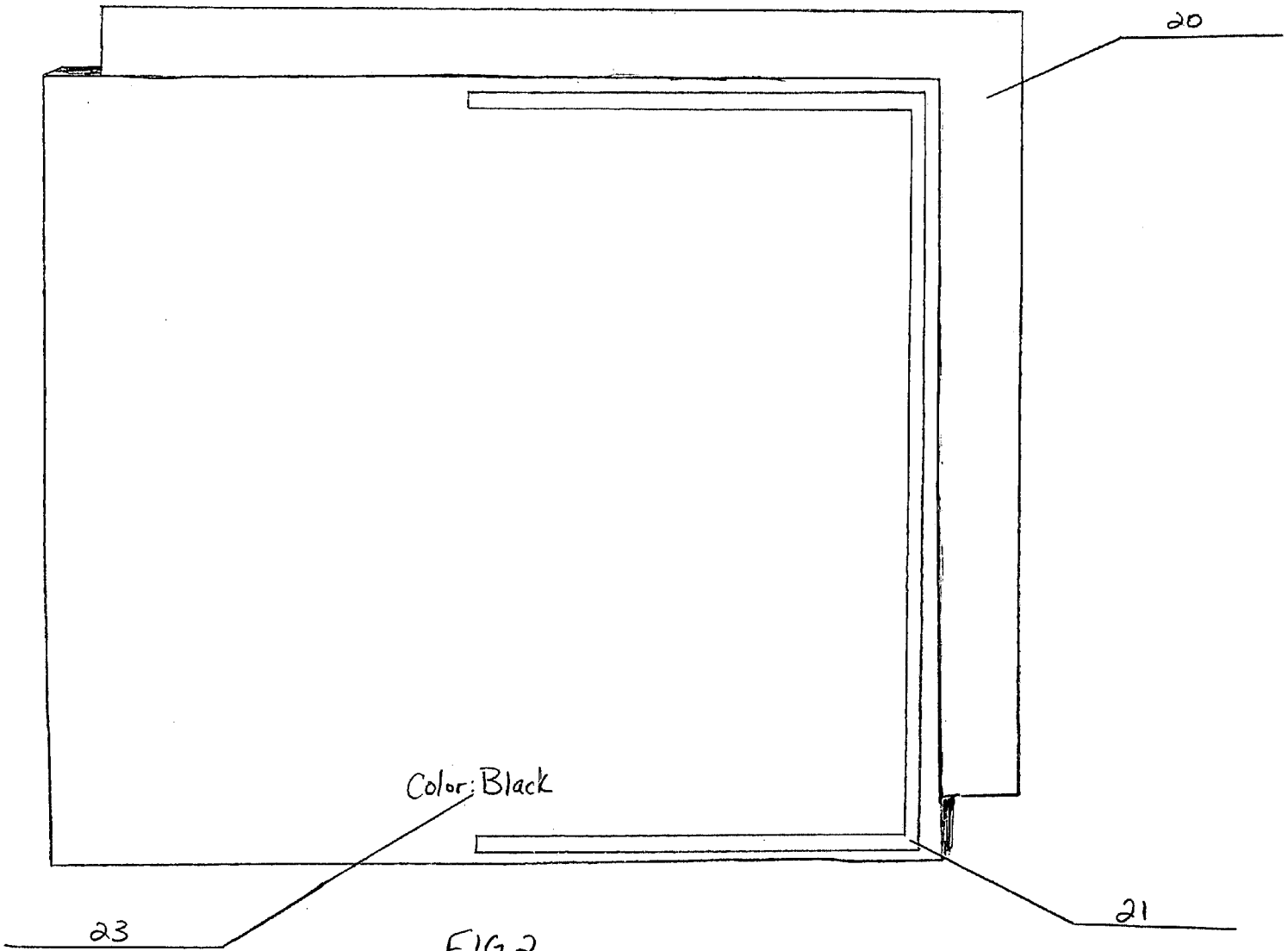
FIG. 2—is a view of the page showing the stencil holes for the border that lines up the master page.

Turning to FIG. 2, shown therein is a view of the page of the invention showing the indicated color black 23 that will be colored through the border stencil holes 21 to create the boreder line up on the master page 20.

Figure 3:
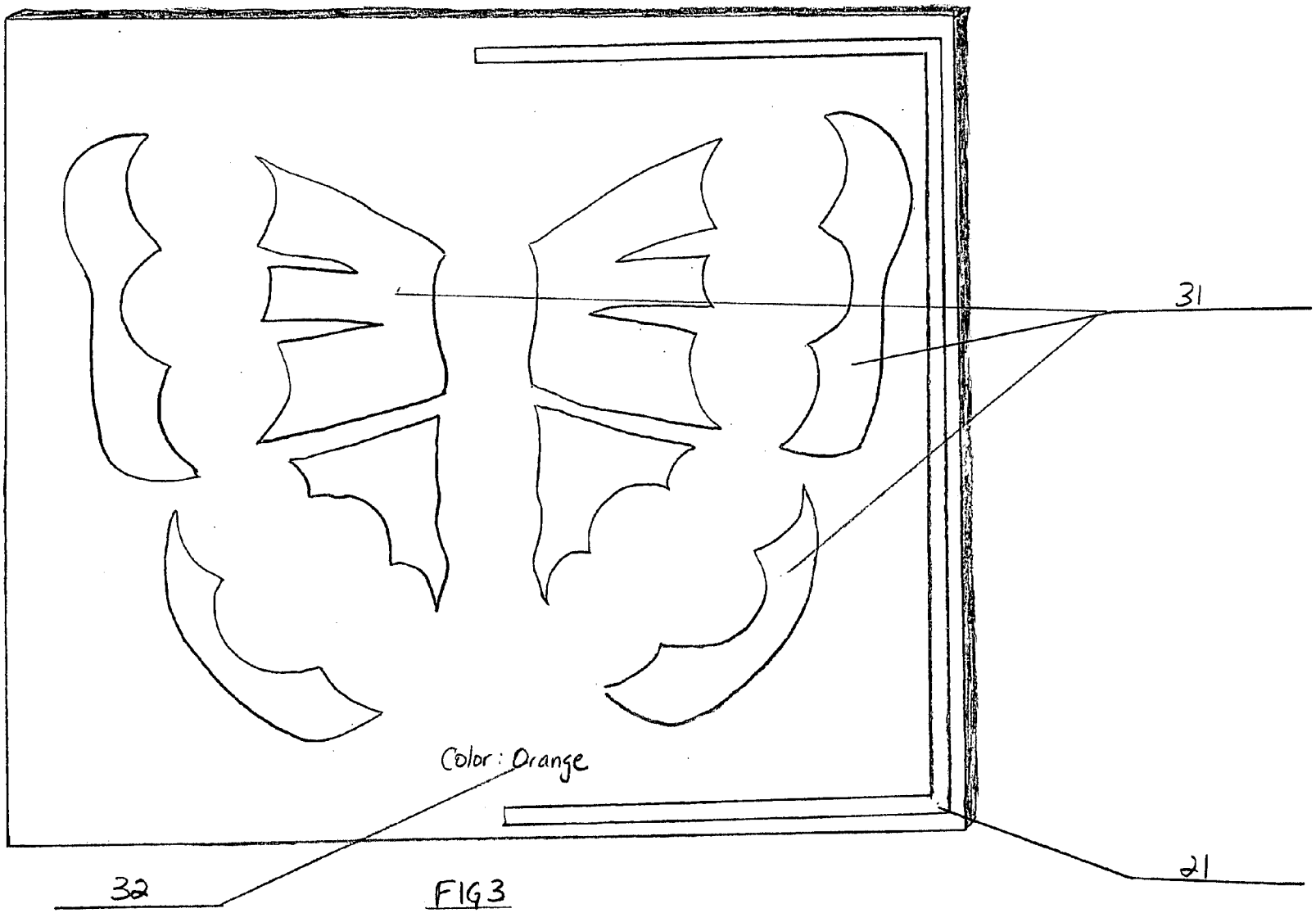
FIG. 3—is a view of the second page showing the stencil holes for all the orange colors in the picture and the black border stencil holes to line up the master page.

Turning to FIG. 3, shown therein is a view of the page of the invention showing the indicated color orange 32 that will be colored through the orange stencil holes 31 after lining up the master page 20 with the border stencil holes 21.

Figure 4:
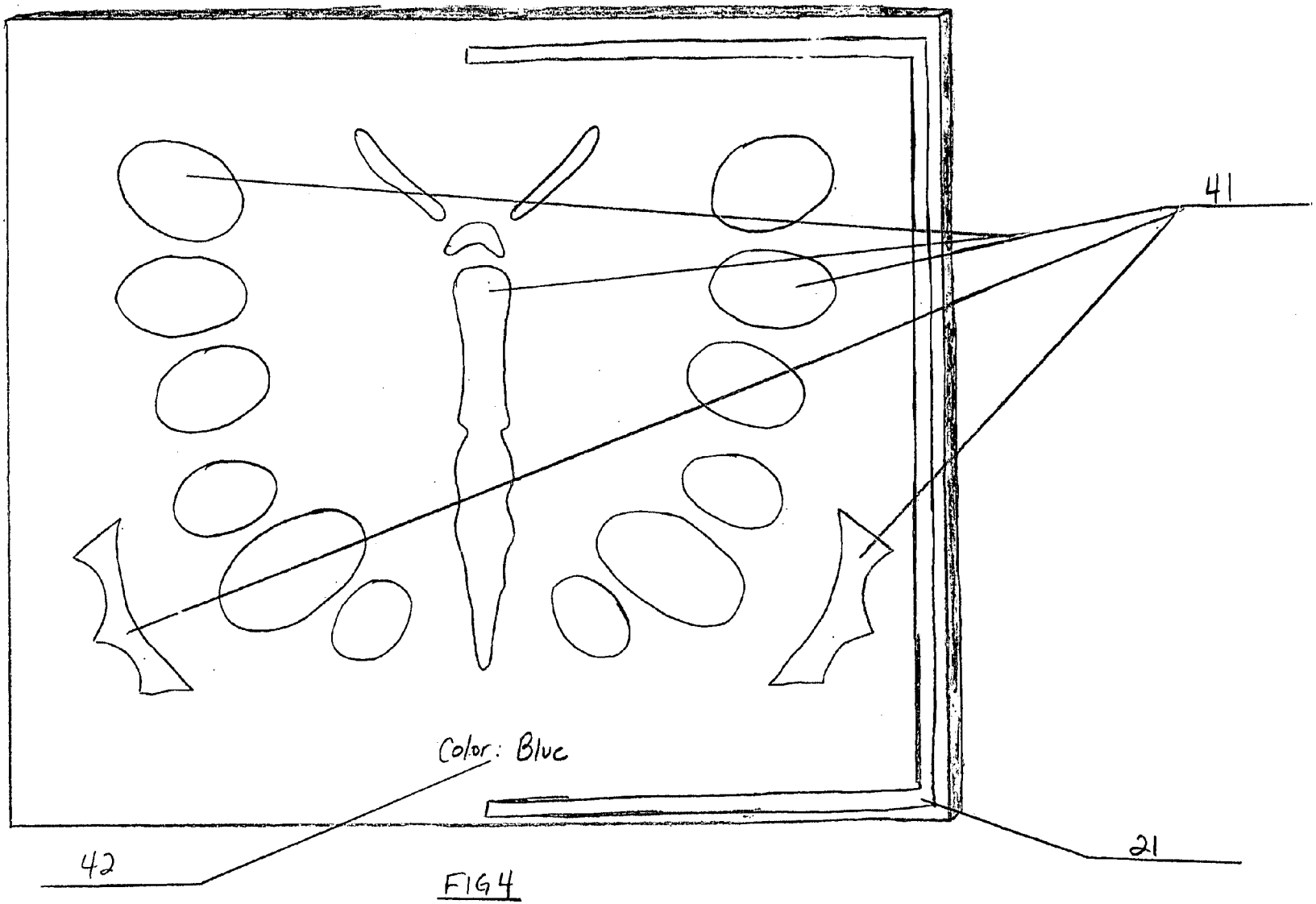
FIG. 4—is a view of the page showing the stencil holes for all the blue colors in the picture and the black border stencil holes to line up the master page.

Turning to FIG. 4, shown therein is a view of the page of the invention showing the indicated color blue 42 that will be colored through the blue stencil holes 41 after lining up the master page 20 with the border stencil holes 21.

Figure 5:
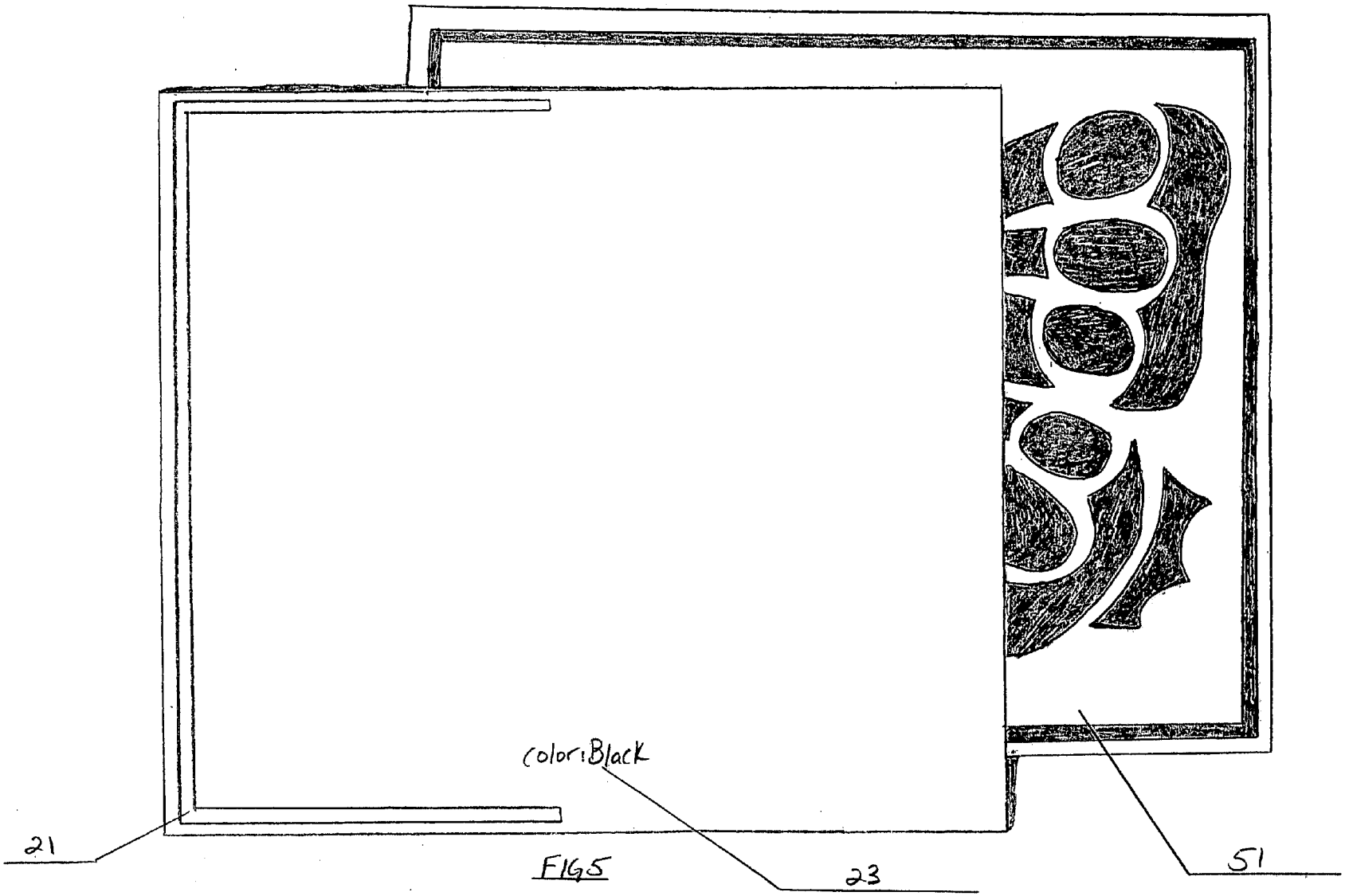
FIG. 5—is a view of page showing the stencil holes for the completion of the border to line up the master page.

Turning to FIG. 5, shown therein is a view of the page of the invention showing the indicated color black 23 that will be colored through the border stencil hole 21 to finish the border on the master page 20 completing the finished picture 51.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method of creating a multicolor picture having a continuous border surrounding a multicolor image, the method comprising the steps of:

providing a first border stencil page having at least one border opening for forming a portion of a continuous border on a master page, positioning the first border stencil page over the master page and applying a coloring material through the at least one border opening to form the portion of the continuous border on the master page, providing separate color stencil pages for each color of the picture to be colored onto a master page, each of said separate stencil pages having color openings corresponding to one color portion of the multicolor image and having at least one alignment opening corresponding to the portion of the continuous border formed on the master page, placing each color stencil page in alignment with the master page by lining up the alignment opening on the color stencil page with the portion of the continuous border formed on the master page, applying coloring material through the color openings of each color stencil page to form respective color portions of the multicolor image;

providing a second border stencil page having at least one complementary border opening for forming the remainder of the continuous border surrounding the multicolor image on the master page;

positioning the second border stencil page over the master page in alignment with the portion of the continuous border on the master page and applying a coloring material through the at least one complementary border opening to form the remainder of the continuous border surrounding the multicolor image.

* * * * *